US008657530B2

(12) United States Patent
Anderson et al.

(10) Patent No.: US 8,657,530 B2
(45) Date of Patent: Feb. 25, 2014

(54) SUBSEA PIPE STUB PULLING DEVICES AND METHODS

(75) Inventors: Paul E. Anderson, Peyton, CO (US); Luis Javier Gutierrez, Houston, TX (US); Troy A. Fraske, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 76 days.

(21) Appl. No.: 13/451,113

(22) Filed: Apr. 19, 2012

(65) Prior Publication Data

US 2012/0269578 A1 Oct. 25, 2012

Related U.S. Application Data

(60) Provisional application No. 61/477,309, filed on Apr. 20, 2011.

(51) Int. Cl.
*B66C 1/42* (2006.01)
*E21B 19/00* (2006.01)

(52) U.S. Cl.
USPC ..... 405/158; 405/173; 166/338

(58) Field of Classification Search
USPC ..... 405/158, 173; 166/77.1, 85.1, 338, 340, 166/348
See application file for complete search history.

(56) References Cited

U.S. PATENT DOCUMENTS 1,758,364 A 5/1930 Jensen
4,585,369 A * 4/1986 Manesse et al. ..... 403/322.3
5,810,079 A * 9/1998 Lynde et al. ..... 166/55.6
5,899,268 A * 5/1999 Lynde et al. ..... 166/55.6
5,947,642 A * 9/1999 Teixeira et al. ..... 405/195.1
7,891,429 B2 * 2/2011 Boyce et al. ..... 166/340

FOREIGN PATENT DOCUMENTS

DE 354393 6/1922
WO 2008084134 A1 7/2008

OTHER PUBLICATIONS

PCT International Search Report and the Written Opinion of the International Search Authority, or the Declaration, issued for International application No. PCT/US2012/034205, mailed on Oct. 16, 2012, 11 pages.

* cited by examiner

*Primary Examiner* — Benjamin Fiorello
(74) *Attorney, Agent, or Firm* — Jayne C. Piana

(57) ABSTRACT

A device for retrieving a subsea tubular comprises a housing. In addition, the device comprises a receiving body slidingly disposed within the housing. The body has a central axis, a lower end, and a receptacle extending from the lower end. Further, the device comprises an actuation member configured to move the housing axially relative to the body. Still further, the device comprises a plurality of cam members. Each cam member is rotatably coupled to the lower end of the body and has a cam head extending radially into the receptacle and a lever arm extending from the cam head. Each cam member is configured to rotate in a first direction to move the cam head radially inward and rotate in a second direction to move the cam head radially outward. Moreover, the device comprises a plurality of biasing members configured to bias the cam members in the first direction.

23 Claims, 16 Drawing Sheets

SUBSEA PIPE STUB PULLING DEVICES AND METHODS

CROSS-REFERENCE TO RELATED APPLICATIONS

This application claims benefit of U.S. provisional patent application Ser. No. 61/477,309 filed Apr. 20, 2011, and entitled "Subsea Pipe Stub Pulling Device and Methods," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to remedial devices and methods for subsea hydrocarbon drilling and production operations. More particularly, the invention relates to devices and methods for removing a tubular stuck inside a larger component subsea.

2. Background of the Technology

In hydrocarbon drilling and production operations, it is common to have tubulars extending through other pieces of equipment such as manifolds, blow-out preventers (BOPs), wellheads, Christmas trees, other pipes or pipelines, etc. During maintenance and/or remedial operations, it may be necessary to remove such tubulars from the equipment to access passages or bores in the equipment, to advance other tools or devices through the equipment, or to break down or remove the equipment. For example, in the event of a blowout, it may be necessary to remove a tubular from another component to gain access to the component or to couple another device to the component.

On land, such remedial operations may be relatively easy if the captive pipe can be directly accessed and engaged at the surface with tongs or other suitable clamping devices. However, if the captive pipe is remote from the associated surface operations (e.g., disposed downhole or subsea), it may be more difficult to sufficiently grasp and remove the captive tubular.

Accordingly, there remains a need in the art for devices and methods to securely grasp and remove captive tubulars from equipment. Such devices and methods would be particularly well-received if they were suitable for remote, subsea remedial operations.

BRIEF SUMMARY OF THE DISCLOSURE

These and other needs in the art are addressed in one embodiment by a device for retrieving a subsea tubular. In an embodiment, the device comprises a housing having a housing first end and an opened end opposite the housing first end. In addition, the device comprises a receiving body slidingly disposed within the housing. The body has a central axis, body first end proximal the housing first end, a body second end proximal the opened end of the housing, and a receptacle extending axially from the opened end of the body. Further, the device comprises an actuation member coupled to the housing and the body. The actuation member is configured to move the housing axially relative to the body. Still further, the device comprises a plurality of cam members. Each cam member is rotatably coupled to the opened end of the body and has a longitudinal axis, a cam head at a first end extending radially into the receptacle, and a lever arm extending from the cam head to a second end opposite the first end. Each cam member is configured to rotate in a first direction to move the cam head radially inward relative to the central axis and rotate in a second direction opposite the first direction to move the cam head radially outward relative to the central axis. The lower end of the housing axially abuts the lever arm of each cam member. Moreover, the device comprises a plurality of biasing members. Each biasing member is coupled to the lever arm of one cam member and configured to bias the cam member in the first direction.

These and other needs in the art are addressed in another embodiment by a method for retrieving a tubular lodged in a subsea component. In an embodiment, the method comprises (a) positioning a retrieval tool subsea to the tubular. The tool comprises an outer housing, a tubular receiving body disposed within the housing, and a plurality of circumferentially spaced cam members rotatably coupled to the lower end of the body. The body has a central axis, a first end, a second end opposite the first end, and a receptacle extending axially from the second end. Each cam member has a cam head extending radially into the receptacle and a lever arm extending from the cam head. In addition, the method comprises (b) receiving an end of the tubular into the receptacle. Further, the method comprises (c) moving the housing axially upward relative to the body. Still further, the method comprises (d) pivoting each cam member in a first direction relative to the body during (c) to engage the tubular with a gripping surface of each cam head.

These and other needs in the art are addressed in another embodiment by a method for retrieving a subsea tubular. In an embodiment, the method comprises (a) positioning a retrieval device subsea. The device comprises a housing, a body moveably disposed within the housing, and a plurality of circumferentially spaced cam members rotatably coupled to the body. The body has a central axis and a receptacle for receiving an end of the tubular. Each cam member has a cam head extending radially into the receptacle. In addition, the method comprises (b) positioning the end of the tubular in the receptacle with one or more subsea ROVs. Further, the method comprises (c) moving the housing axially upward relative to the body with the one or more subsea ROVs. Still further, the method comprises (d) moving each cam head into engagement with the tubular during (c).

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
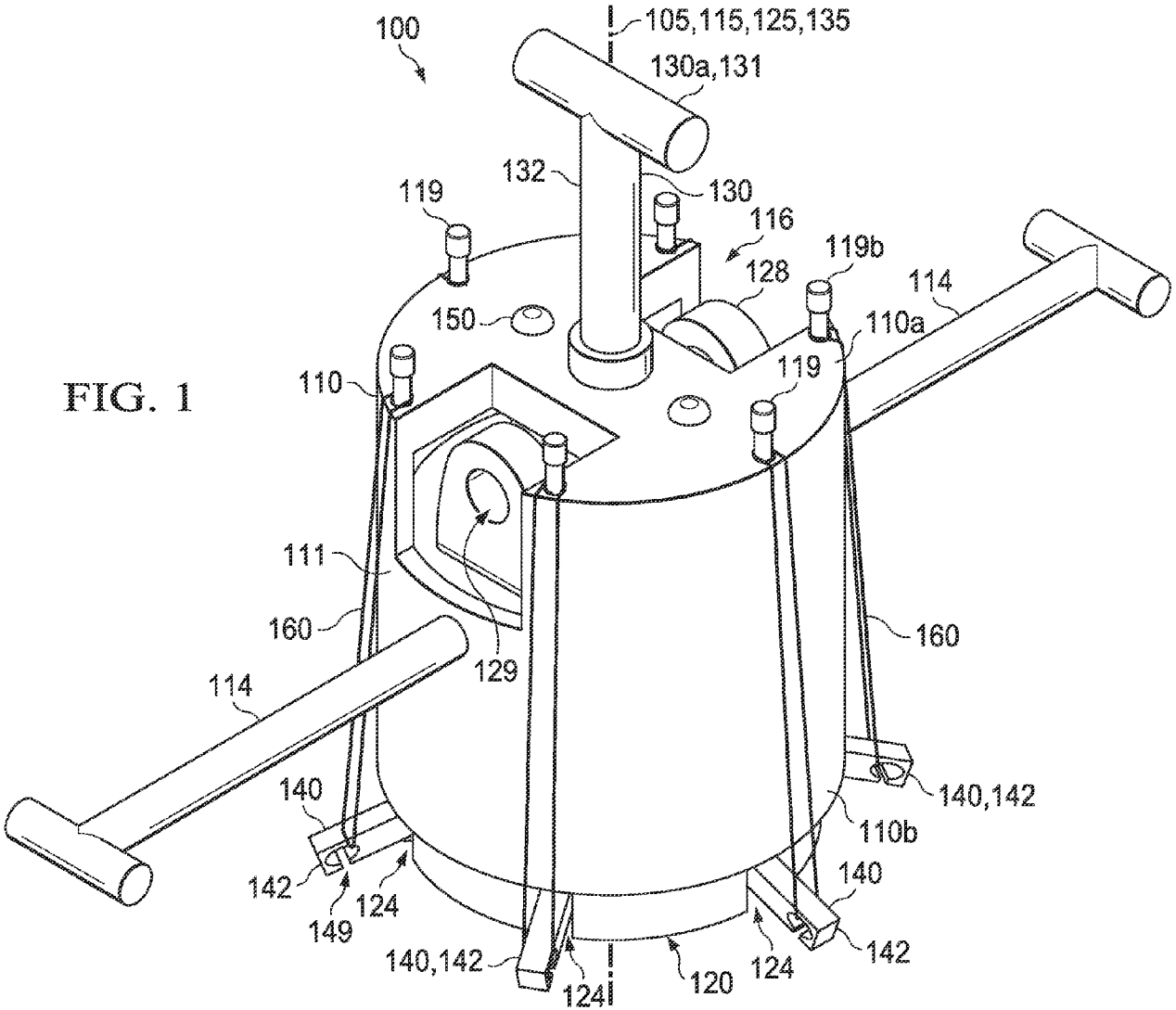
FIG. 1 is a perspective view of an embodiment of a pipe stub pulling tool in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
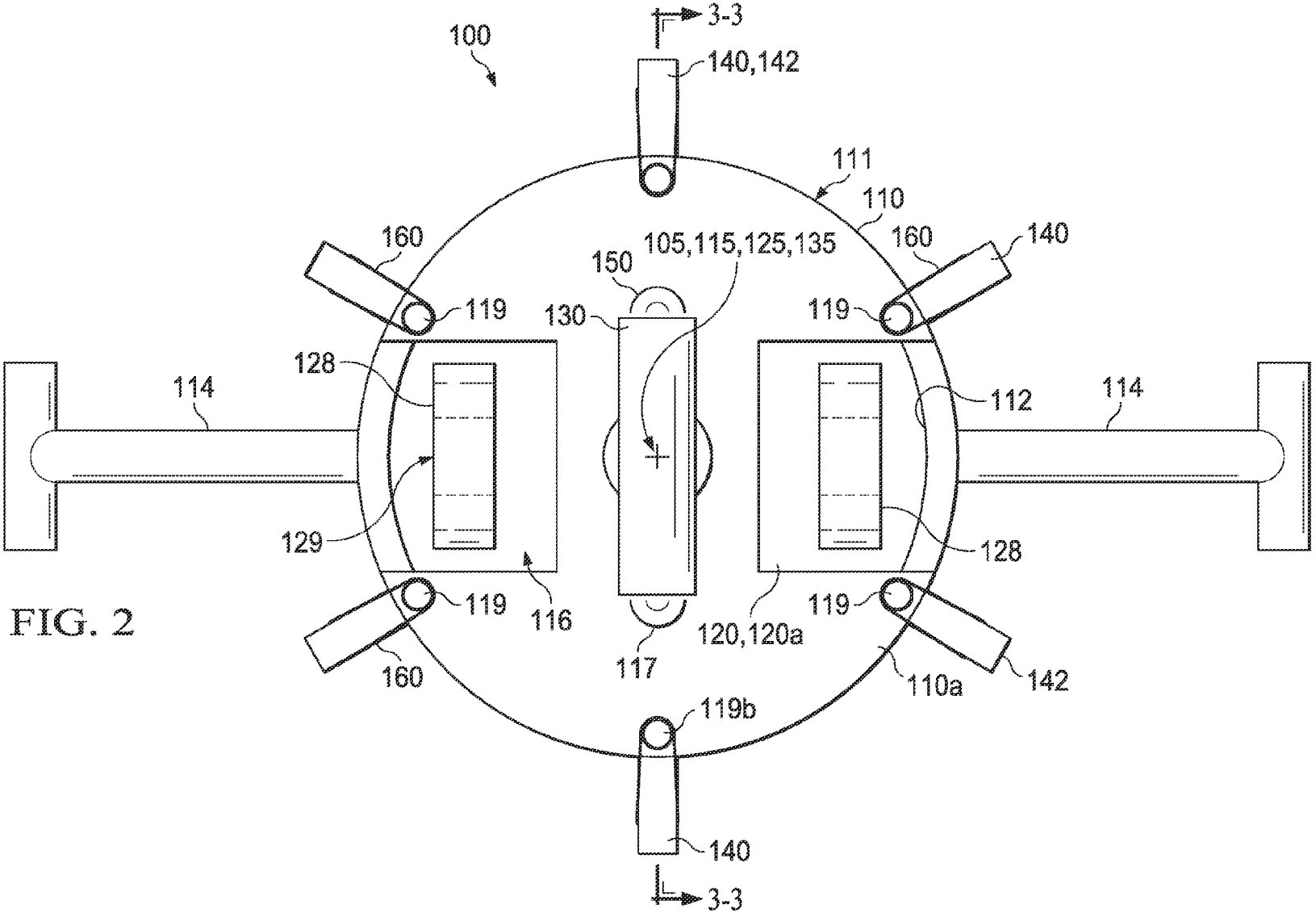
FIG. 2 is a top view of the tool of FIG. 1.
Figure 3:
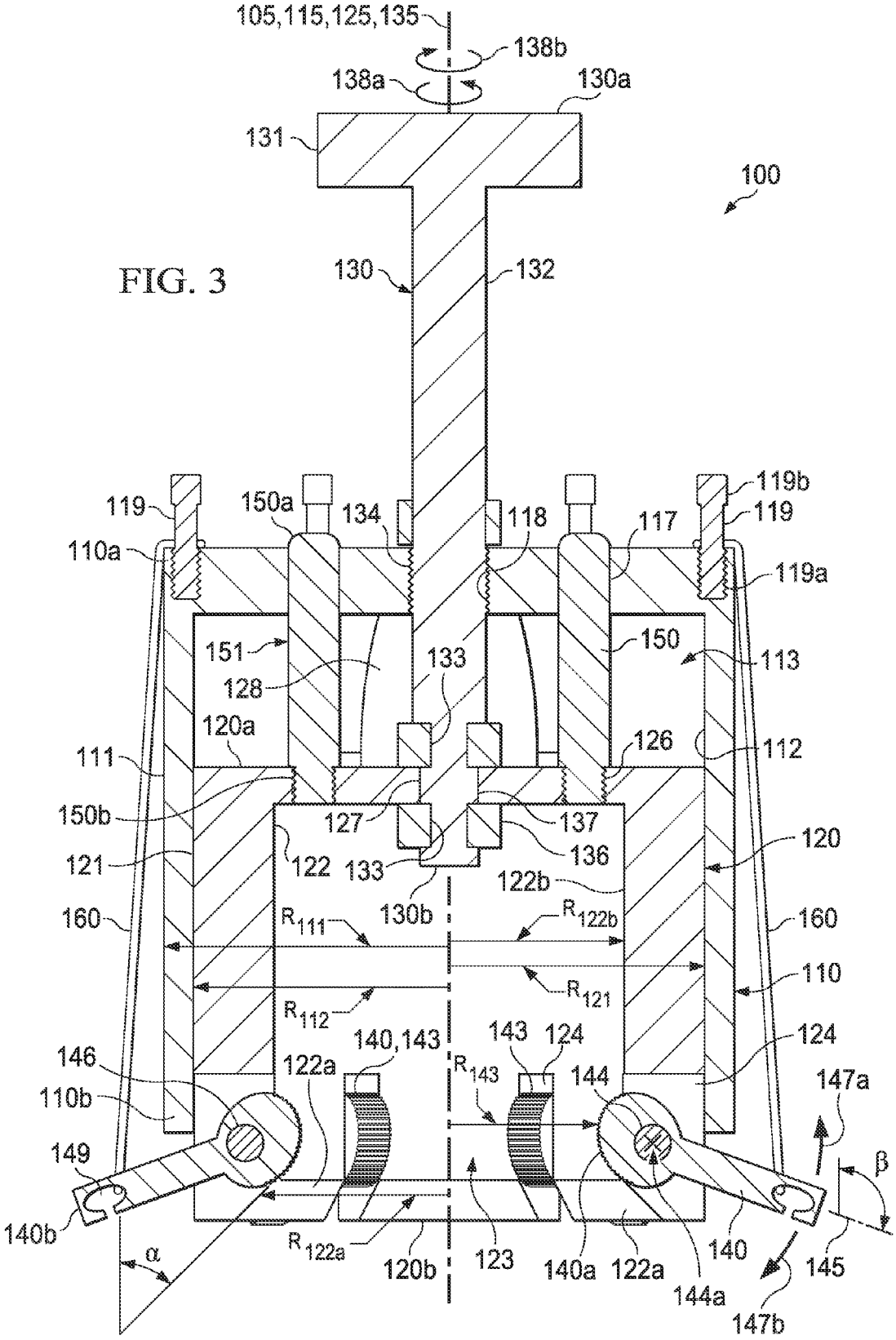
FIG. 3 is a cross-sectional view of the tool of FIG. 1 taken along section 3-3 of FIG. 2.

Referring now to FIGS. 1-3, an embodiment of a pipe stub pulling tool 100 is shown. In general, tool 100 is employed to pull and retrieve short segments of pipe or tubulars retained in a larger component subsea (e.g., at the sea floor). In this embodiment, tool 100 has a central axis 105 and includes a radially outer release body or housing 110, a stub receiving body 120 coaxially disposed within housing 110, an actuation member 130 extending between housing 110 and body 120, and a plurality of cam members 140 rotatably coupled to body 120.

Housing 110 has a central axis coincident with tool axis 105, a housing first or upper end 110*a*, and a second or lower opened end 110*b* opposite end 110*a*. In addition, housing 110 has a radially outer cylindrical surface 111 extending between ends 110*a, b*, and a radially inner cylindrical surface 112 defining an inner chamber 113 extending axially from lower end 110*b*. Outer surface 111 is disposed at a uniform radius $R_{111}$ and inner surface 112 is disposed at a uniform radius $R_{112}$. In this embodiment, two circumferentially spaced tee-shaped handles 114 extend radially from outer surface 111. As will be described in more detail below, during subsea deployment and operation of tool 100, handles 114 are used to control and adjust the position and orientation of tool 100. Although handles 114 are "T-shaped" in this embodiment, in general, the handles (e.g., handles 114) may have any suitable shape or geometry suitable for grasping with a subsea ROV including, without limitation, C-shaped, E-shaped, etc.

Lower end 110*b* of housing 110 is open to chamber 113, however, upper end 110*a* is generally closed except for a plurality of uniformly circumferentially spaced access apertures 116, a plurality of uniformly circumferentially spaced guide bores 117, and a threaded throughbore 118. Apertures 116, bores 117, and throughbore 118 extend axially through upper end 110*a* to chamber 113. In this embodiment, upper end 110*a* includes two apertures 116 angularly spaced 180° apart about axes 105, 115, and two guide bores 117 angularly spaced 180° apart about axes 105, 115. As best shown in FIG. 2, each guide hole 117 is angularly spaced 90° from each aperture 116 about axes 105, 115. Bore 118 is disposed at the radial center of upper end 110*a* and threadingly engages actuation member 130.

Referring still to FIGS. 1-3, a plurality of uniformly circumferentially spaced coupling members 119 extend axially from upper end 110*a* of housing 110. As best shown in FIG. 2, coupling members 119 are disposed proximal the radially outer periphery of upper end 110*a* of housing 110. In this embodiment, six coupling members 119 are angularly spaced 60° apart about axes 105, 115. As best shown in FIG. 3, in this embodiment, each coupling member 119 is a stud threaded into a mating receptacle in upper end 110*a*. Thus, each coupling member 119 has a threaded shaft 119*a* threaded in one receptacle and an enlarged head 119*b* axially spaced above upper end 110*a*.

Referring now to FIG. 3, body 120 is coaxially disposed in housing 110 and has a central axis 125 coincident with axes 105, 115, a body first or upper end 120*a*, and a body second or lower end 120*b* opposite body first end 120*a*. In addition, body 120 has a radially outer cylindrical surface 121 extending between ends 120*a, b*, and a radially inner surface 122 defining a counterbore or receptacle 123 extending axially from lower end 120*b*. Body 120 also includes a plurality of uniformly circumferentially spaced slots 124 extending axially from lower end 120*b*, each slot 124 extending radially from outer surface 121 to inner surface 122. In this embodiment, body 120 includes six slots 124 angularly spaced 60° apart about axis 125.

Outer surface 121 of body 120 is disposed at a uniform radius $R_{121}$ that is substantially the same or slightly less than inner radius $R_{112}$ of housing 110. Thus, outer surface 121 of body 120 slidingly engages inner surface 112 of housing 110. Inner surface 122 of body 120 includes a plurality of guide surfaces 122*a* extending axially from lower end 120*b* and a cylindrical surface 122*b* extending axially from guide surface 122*a*. Each guide surface 122*a* extends circumferentially between each pair of circumferentially adjacent slots 124. Cylindrical surface 122*b* is disposed at a uniform radius $R_{122b}$, however, each guide surface 122*a* is disposed at a radius $R_{122a}$ that decreases moving axially upward from lower end 120*b* to cylindrical surface 122*b*. In other words, guide surface 122*a* are tapered surfaces, each surfaces 122*a* being disposed at an angle α relative to axis 125 in cross-sectional side view. In this embodiment, angle α is 45°, however, in general, angle α is preferably between 30° and 60°. As will be described in more detail below, the pipe end or stub to be pulled and dislodged by tool 100 is received by receptacle 123. During insertion of the pipe end or stub into receptacle 123, guide surfaces 122*a* urge the end of the pipe or stub into tool 100 into receptacle 123 for sufficient seating therein.

Lower end 120*b* of body 120 is open to receptacle 123, however, upper end 120*a* is closed except for a plurality of uniformly circumferentially spaced threaded guide bores 126 and a central throughbore 127 extending through upper end 120*a* to receptacle 123. In this embodiment, body upper end 120*a* includes two threaded guide bores 126 angularly spaced 180° apart about axes 105, 115, 125. Throughbore 127 is positioned at the radial center of upper end 120*a*. In addition, a plurality of uniformly circumferentially spaced connection members 128 extend axially upward from upper end 120*a* of body 120. Each connection member 128 includes a eye or bore 129 that is employed to secure lifting cables to body 120. In this embodiment, body 120 includes two connection members 128 angularly spaced 180° apart. Each connection member 128 is circumferentially aligned with one aperture 116. Connection members 128 and apertures 116 are sized and positioned such that each member 128 can pass axially through one aperture 116 as body 120 moves axially upward relative to housing 110.

Referring still to FIG. 3, actuation member 130 and a plurality of guide rods 150 extend axially between upper end 120*a* of body 120 and upper end 110*a* of housing 110. In general, actuation member 130 moves body 120 axially relative to housing 110 within chamber 113, and guide rods 150 guide and maintain the axial movement of body 120 relative to housing 110. In particular, actuation member 130 has a central or longitudinal axis 135 coaxially aligned with axes 105, 115, 125, an upper end 130*a* distal body 120*a* and a lower end 130*b* opposite upper end 130*a*. In addition, actuation member 130 includes a tee handle 131 at upper end 130*a* and an elongate shaft 132 extending axially from handle 131 to lower end 130*b*. Shaft 132 includes a pair of axially spaced annular recesses 133 proximal lower end 130*b* and an externally threaded segment 134 positioned axially between handle 131 and recesses 133. An annular collar 136 is seated in each shaft recess 133 and axially fixed to shaft 132. Shaft 132 has a smooth cylindrical outer surface 137 extending between recesses 133.

Shaft 132 extends axially through housing throughbore 118 and body throughbore 127. Shaft 132 is axially positioned relative to housing 110 such that segment 134 threadingly engages throughbore 118 and cylindrical surface 137 slidingly engages throughbore 127. Further, recesses 133 and associated collars 136 are axially positioned along shaft 132 such that the upper collar 136 axially abuts and slidingly engages the outside of body 120 at upper end 120*a* and the lower collar 136 axially abuts and slidingly engages the inside of body 120 at upper end 120*a*. Thus, shaft 132 is permitted to rotate relative to body 120 within throughbore 127, but collars 136 restrict and/or prevent shaft 132 from moving axially relative to body 120. Due to the threaded engagement of segment 134 with housing throughbore 118 and rotational sliding engagement of surface 137 with body throughbore 127, rotation of actuation member 130 about axis 135 in a first direction 138*a* moves body 120 axially upward within housing 110, and rotation of actuation member 130 about axis 135 in a second direction 138*b* opposite first direction 138*a* moves body 120 axially downward within housing 110.

Guide rods 150 help facilitate the axial translation of body 120 within housing 110 while simultaneously restricting body 120 from rotating or twisting relative to housing 110. In other words, guide rods 150 ensure pure axial translation of body 120 relative to housing 110. Specifically, each guide rod 150 has an upper end 150*a*, a threaded lower end 150*b* opposite upper end 150*a*, and a smooth cylindrical outer surface 151 extending between ends 150*a, b*. Guide rods 150 are positioned such that lower end 150*b* of each guide rod 150 threadingly engages one mating guide bore 126 in body 120 and cylindrical surface 151 of each guide rod 150 slidingly engages one housing guide bore 117. Thus, as body 120 is actuated axially relative to housing 110, guide rods 150 move axially along with body 120 and slidingly engage housing guide bores 117.

Referring still to FIG. 3, one cam member 140 is provided for each slot 124, and thus, there are six cam members 140 in this embodiment. In addition, each cam member 140 extends through one slot 124 and is rotatably coupled to body 120. Since each cam member 140 is disposed in one slot 124, and as previously described, slots 124 are uniformly circumferentially spaced apart about lower end 120*b* of body 120, cam members 140 are also uniformly circumferentially spaced about lower end 120*b*. As best shown in FIG. 2, each of the six cam members 140 is also circumferentially aligned with one of the six coupling members 119.

Figure 4:
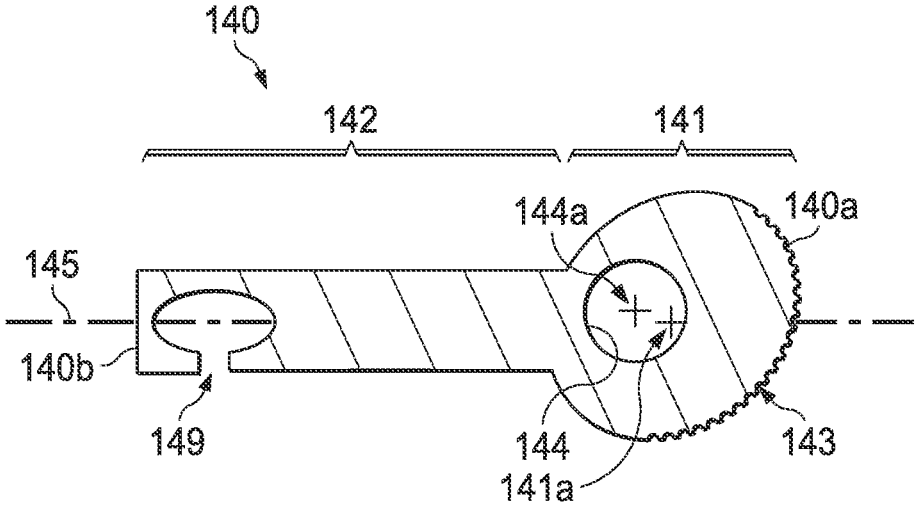
FIG. 4 is a side view of one of the cam members of FIG. 3.

Referring now to FIGS. 3 and 4, in this embodiment, each cam member 140 is identical. Thus, one cam member 140 will be described it being understood that each cam member 140 is configured the same. Cam member 140 has a longitudinal axis 145 oriented at an angle β relative to axes 105, 115, 125 in side view (FIG. 3), a first end 140*a*, and a second end 140*b* opposite end 140*a*. A projection of axis 145 of each cam member 140 intersects axes 105, 115, 125. As will be described in more detail below, axial translation of body 120 relative to housing 110 causes each cam member 140 to rotate in a plane containing both its axis 145 and axes 105, 115, 125, thereby changing angle β. As best shown in FIG. 3, first end 140*a* extends into body receptacle 123 and second end 140*b* is positioned distal axes 105, 115, 125. Accordingly, first end 140*a* may also be referred to as a radially inner end 140*a* (relative to axes 105, 115, 125), and second end 140*b* may also be referred to as a radially outer end 140*b* (relative to axes 105, 115, 125).

Referring still to FIGS. 3 and 4, inner end 140*a* comprises a generally round cam head 141, and an elongate lever arm 142 extends axially (relative to axis 145) from head 141 to outer end 140*b*. In this embodiment, cam head 141 has a generally circular profile in side view. However, in other embodiments, the cam head 141 may have other generally round profiles such as oval or ovoid. Cam head 141 has a central axis 141*a* passing through the geometric center of head 141. Head axis 141*a* is perpendicular to and intersects axis 145, and is generally parallel to a plane tangent to cylindrical inner surface 122*b* of body 120 at its corresponding slot 124. In addition, cam head 141 has a radially outer (relative to axis 141*a*) generally cylindrical grip surface 143 and a throughbore 144. As will be described in more detail below, grip surface 143 is configured to releasably engage the pipe end or stub extending into receptacle 123. In this embodiment surface 143 is textured (e.g., knurled) to enhance frictional engagement between surface 143 and the pipe end or stub it engages. Throughbore 144 of cam head 141 has a central axis 144*a* that is perpendicular to and intersects axis 145, parallel to axis 141*a*, and offset from axis 141*a*. In particular, axis 144*a* is axially positioned (relative to axis 145) between axis 141*a* and end 140*b*. As a result, axis 144*a* is positioned radially outward of axis 141*a* relative to axes 105, 115, 125.

Referring specifically to FIG. 3, as previously described, each cam member 140 is rotatably coupled to body 120. In particular, body 120 includes a pivot pin 146 that extends generally circumferentially across each slot 124 through throughbore 144 of the corresponding cam head 141. Cam member 140 is free to rotate about axis 144*a* and pivot pin 146, thereby changing angle β. As angle β changes, the radial distance that cam head 141 extends into receptacle 123 also changes. More specifically, each cam head 141 extends radially into receptacle 123 to a radius $R_{143}$ measured perpendicularly from axes 105, 115, 125 to the radially innermost portion of grip surface 143. Due to the offset of axis 144*a* from axis 141*a*, as each lever arm 142 is urged upward and rotated about its respective pivot pin 146 in a first direction 147*a*, angle β decreases and radius $R_{143}$ decreases. However, as lever arm 142 is urged downward and rotated about its respective pivot pin 146 in a second direction 147*b* opposite first direction 147*a*, angle β increases and radius $R_{143}$ increases. In this manner, rotation of each cam member 140 about axis 144*a* and pivot pin 146 moves its corresponding grip surface 143 radially inward and radially outward relative to axes 105, 115, 125 and the pipe end or stub disposed in receptacle 123.

Referring again to FIGS. 1-3, tool 100 includes a plurality of biasing members 160, each biasing member 160 extending from one coupling member 119 to one lever arm 142 that is circumferentially aligned with that coupling member 119. In general, biasing members 160 bias or urge their respective lever arms 142 upward in first direction 147*a*, thereby biasing the corresponding cam heads 141 and grip surfaces 143 radially inward relative to axes 105, 115, 125. In general, each biasing member 160 preferably comprises a durable resilient material capable of exerting a biasing force on lever arms 142 and suitable for subsea use such as elastomeric bands or O-rings. In this embodiment, each biasing member 160 is a resilient elastic band disposed about its corresponding coupling member 119 between housing upper end 110*a* and head 119*b*, and seated in a tee-shaped recess 149 proximal outer end 140*b* of cam members 140. However, in other embodiments, the biasing members (e.g., members 160) may comprise resilient steel springs or other suitable devices.

Figure 5:
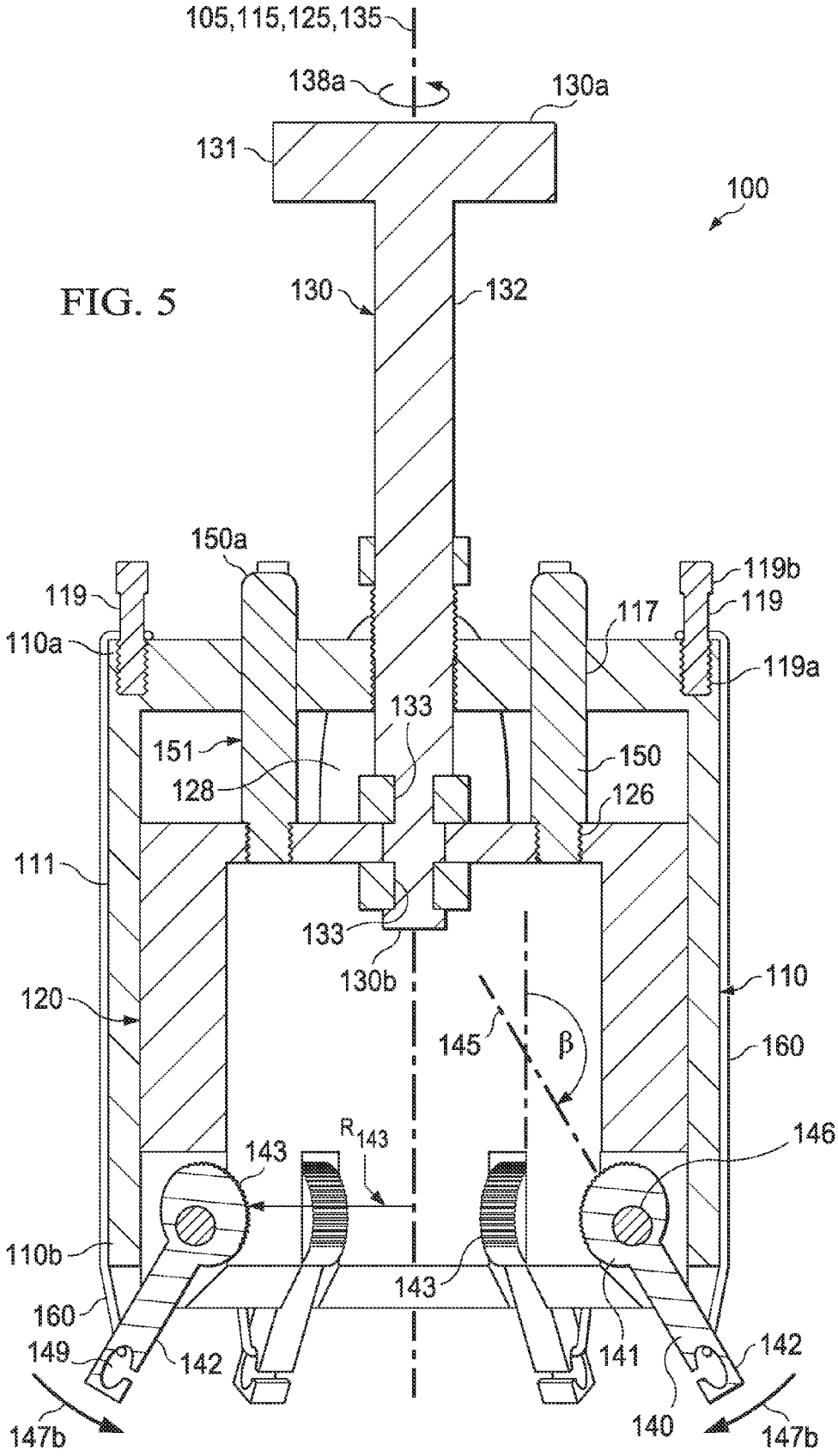
FIG. 5 is a cross-sectional view of the tool of FIG. 1 with the gripping surfaces of the cam members radially retracted.
Figure 6:
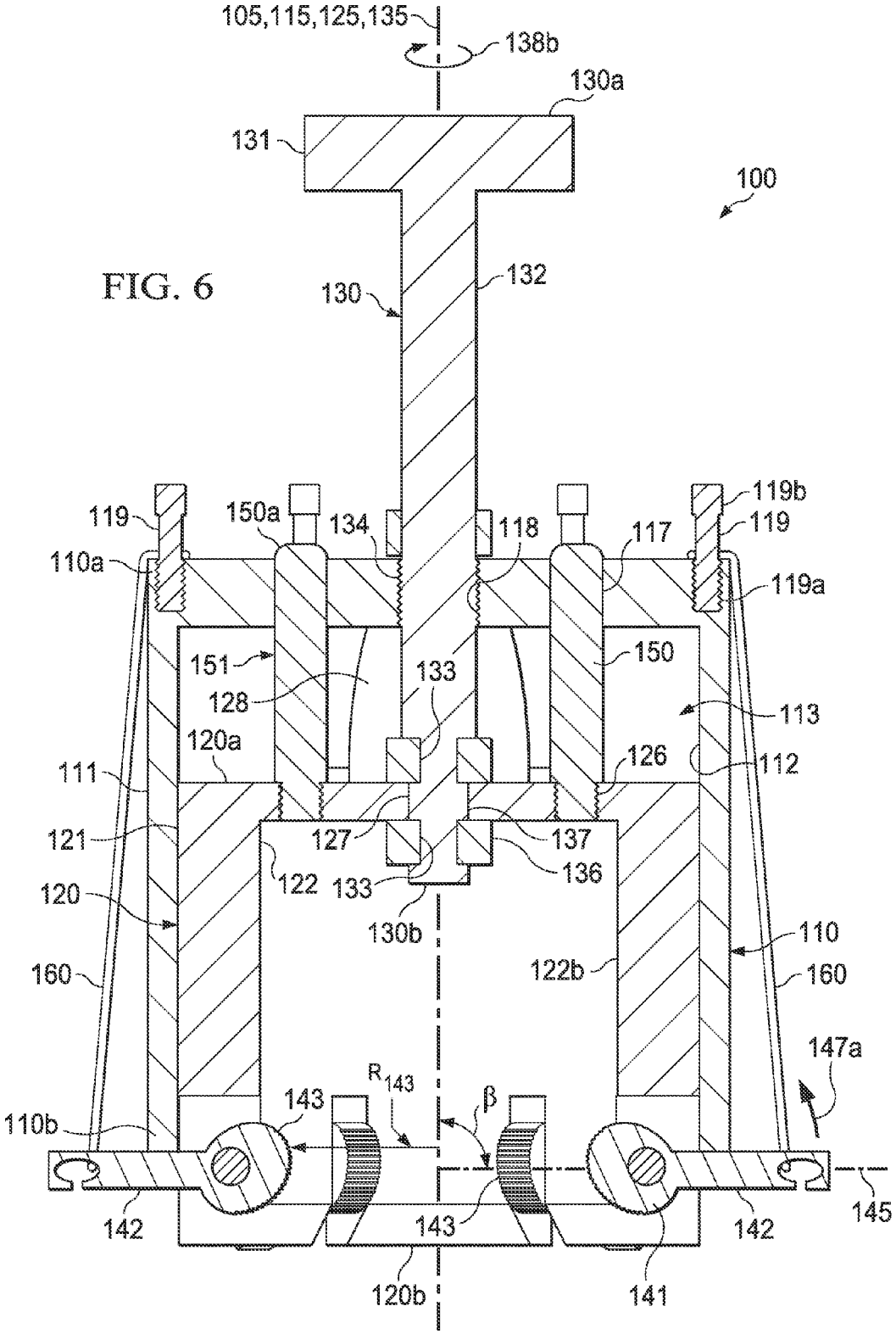
FIG. 6 is a cross-sectional view of the tool of FIG. 1 with the gripping surfaces of the cam members radially advanced.

Although biasing members 160 bias lever arms 142 upward in first direction 147*a*, housing 110 limits the upward movement of lever arms 142 in direction 147*a*, thereby limiting the rotation of cam members 140. In particular, lower end 110*b* of housing 110 axially abuts each lever arm 142 proximal its corresponding cam head 141, and prevents further upward movement of lever arms 142 in first direction 147*a*. By adjusting the axial position of body 120 relative to housing 110, the angle β of each cam member 140 relative to axes 105, 115, 125 and the radius $R_{143}$ to each gripping surface 143 can be controlled and adjusted. For example, in FIG. 5, body 120 has been moved axially upward relative to housing 110 (i.e., housing 110 has been moved axially downward relative to body 120) by rotating actuation member 130 about axis 135 in first direction 138*a*. As a result, lower end 110*b* of housing 110 moves axially downward relative to cam members 140 and pushes lever arms 142 in second direction 147*b*, thereby increasing angle β of each cam member 140 to about 150° and increasing radius $R_{143}$ to each gripping surface 143. Due to the increase in radii $R_{143}$ relative to axes 105, 115, 125, gripping surfaces 143 and cam heads 141 may be described as being radially withdrawn or retracted relative to axes 105, 115, 125. However, in FIG. 6, body 120 has been moved axially downward relative to housing 110 (i.e., housing 110 has been moved axially upward relative to body 120) by rotating actuation member 130 about axis 135 in second direction 138*b*. As a result, lower end 110*b* of housing 110 moves axially upward relative to cam members 140, thereby allowing biasing members 160 to pull lever arms 142 upward in first direction 147*a*, thereby decreasing angle β of each cam member 140 to about 90° and decreasing radius $R_{143}$ to each gripping surface 143. Due to the decrease in radii $R_{143}$ relative to axes 105, 115, 125, gripping surfaces 143 and cam heads 141 may be described as being radially advanced relative to axes 105, 115, 125.

As previously described, biasing members 160 preferably comprise a resilient elastic material. However, the remaining components of tool 100 (e.g., housing 110, body 120, actuation member 130, cam members 140, etc.) preferably comprise rigid, durable materials suitable for subsea use such as stainless steel.

Referring now to FIGS. 7-13, tool 100 is shown being deployed and operated subsea to engage, grip, and retrieve a pipe end or stub 210 retained in a subsea component 220 disposed along the sea floor 201. More specifically, in FIGS. 7 and 8, tool 100 is shown being lowered subsea and coaxially aligned with stub 210; in FIGS. 9 and 10, tool 100 is shown being receiving stub 210 in receptacle 123; and in FIGS. 11 and 12, tool 100 is shown being actuated to positively engage stub 210 with cam heads 141; and in FIG. 13, tool 100 is shown being pulled upward to dislodge stub 210 from component 220. In general, component 220 may comprise any component, piece of equipment or hardware within which a tubular, pipe joint, or pipe stub may get stuck including, without limitation, a BOP, a manifold, a Christmas tree, or another subsea pipe or pipeline.

For subsea deployment and operation, one or more remote operated vehicles (ROVs) are preferably employed to aid in positioning tool 100 and actuating tool 100, as well as monitoring tool 100. In this embodiment, two ROVs 230 are employed to position, actuate, and monitor tool 100. Each ROV 230 includes an arm 231 having a claw 232, a subsea camera 233 for viewing the subsea operations (e.g., the relative positions of tool 100 and stub 210, the positions and movement of arms 230 and claws 232, etc.), and an umbilical 234. Streaming video and/or images from cameras 233 are communicated to the surface or other remote location via umbilical 234 for viewing on a live or periodic basis. Arm 231 and claw 232 are controlled via commands sent from the surface or other remote location to ROV 230 through umbilical 234.

Referring first to FIGS. 7-10, a cable 170 is secured to each connection member 128 through eye 129. Apertures 116 provide clearance for cables 170 and members 128 to extend through upper end 110*a* of housing 110. As will be described in more detail below, relatively high tensile loads are applied to cables 170 from the surface to pull tool 100 upward to dislodge stub 210 after tool 100 has been secured thereto. Accordingly, cables 170 are preferably relatively strong cables capable of withstanding the anticipated tensile loads such as steel cable. A winch or crane mounted to a surface vessel is preferably employed to apply the tensile loads and lifting forces to cables 170.

Figure 7:
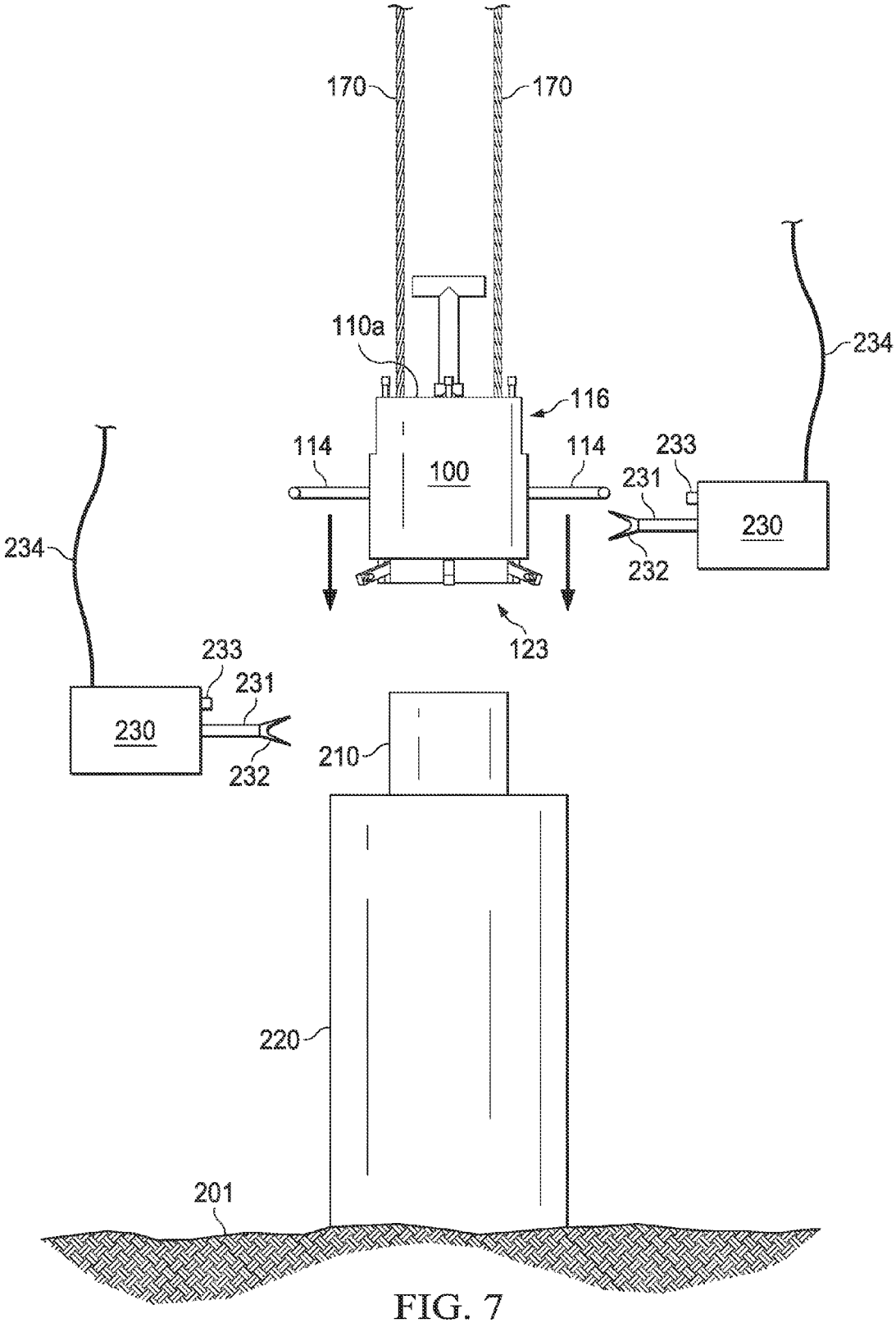
FIGS. 7-10 schematically illustrate the tool of FIG. 1 being deployed subsea to free a pipe stub lodged in a subsea component.
Figure 8:
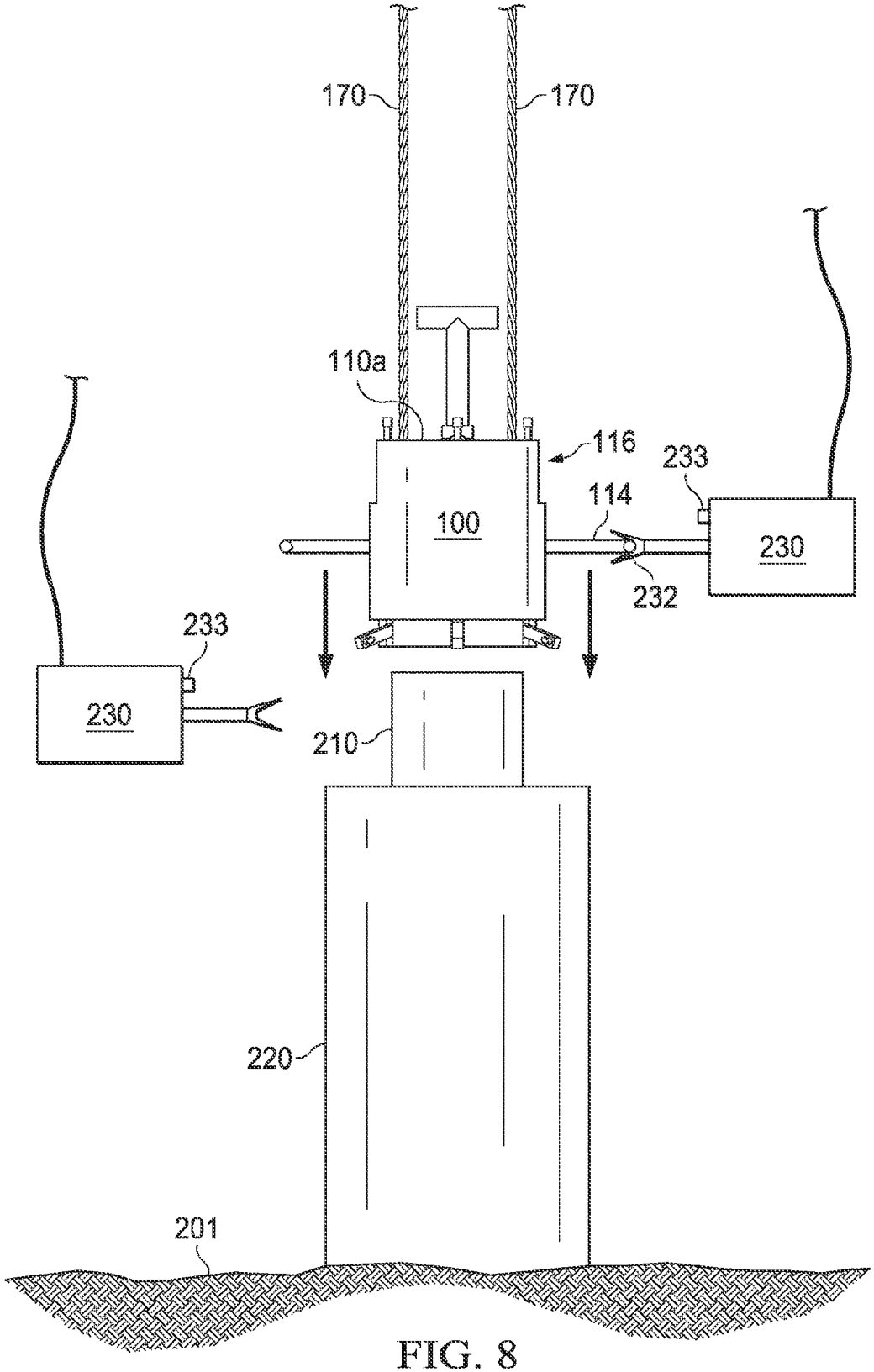
Figure 9:
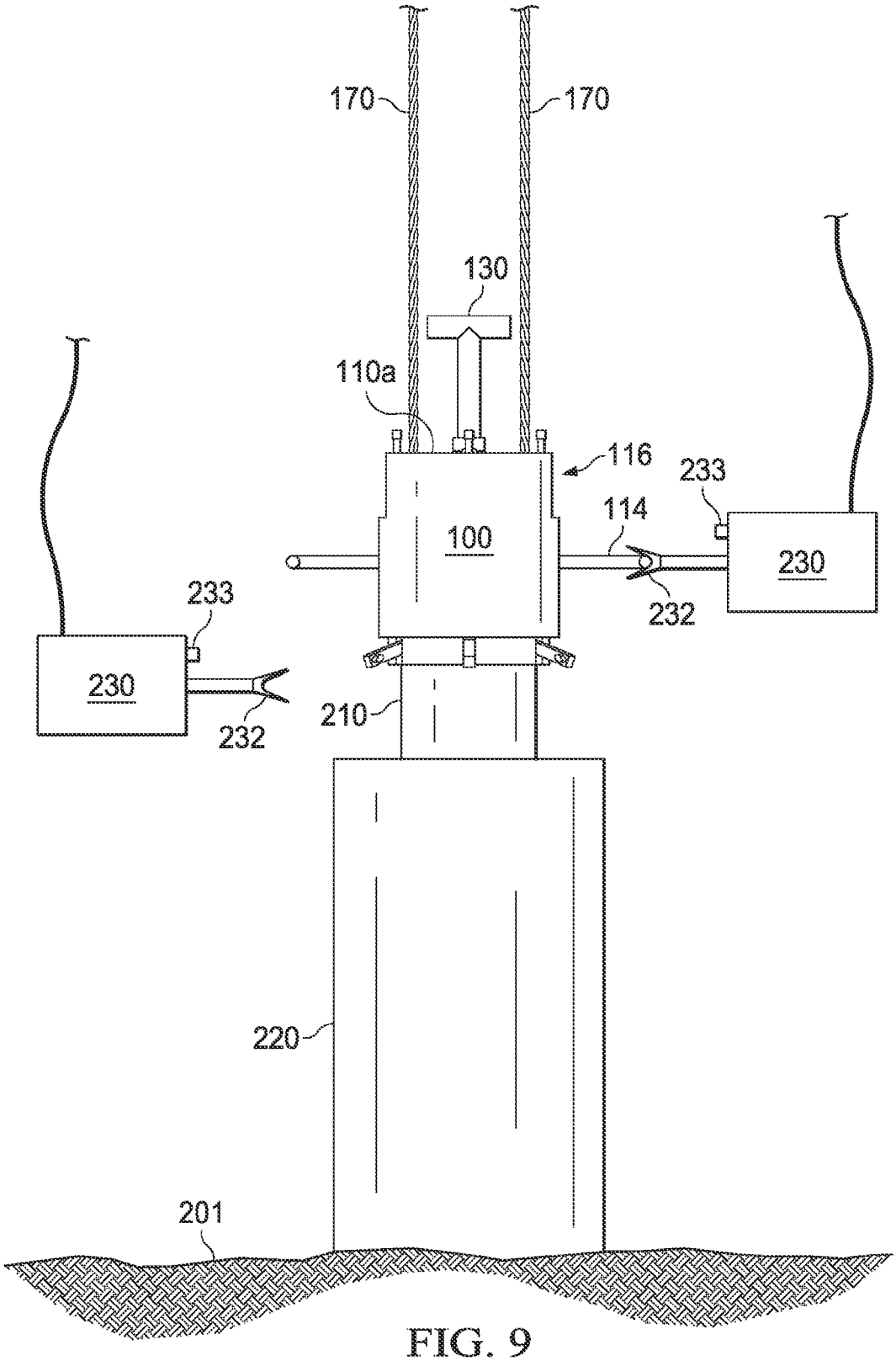
Figure 10:
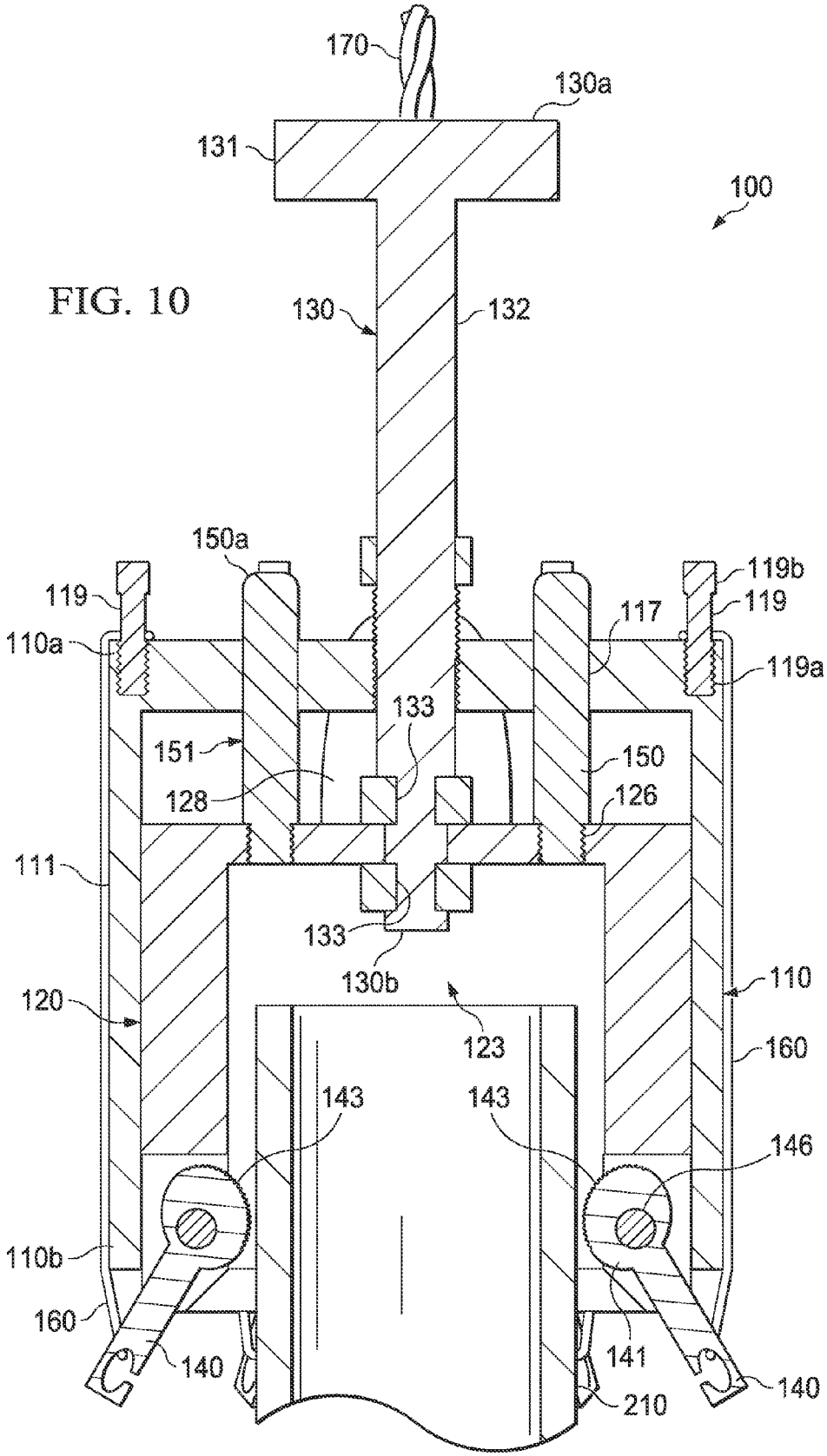

Using cables 170, tool 100 is lowered subsea from a location generally above component 220 as shown in FIG. 7. In this embodiment, tool 100 has a sufficient weight to sink to component 220 under the force of gravity. Before or during subsea deployment, tool 100 is actuated to radially retract grip surfaces 143 relative to axes 105, 115, 125 to provide sufficient radial clearance for receipt of stub 210 into receptacle 123. In other words, the radius $R_{143}$ to each grip surface 143 is greater than the outer radius of stub 210. Moving now to FIG. 8, as tool 100 descends and approaches stub 210, ROVs 230 monitor the position of tool 100 relative to stub 210. In addition, one or more ROVs 230 may utilize their claws 232 to position tool 100 directly above and substantially coaxially aligned with stub 210. Cables 170 continue to lower tool 100 as ROVs 230 facilitate the positioning of tool 100 to coaxially receive stub 210 within receptacle 123 as shown in FIGS. 9 and 10. As shown in FIG. 10, with gripping surfaces 143 radially retracted, a small radial clearance is provided between gripping surfaces 143 and stub 210. Such radial clearances allow stub 210 to be advanced into receptacle 123 and tool 100 to be adjusted about stub 210.

Figure 11:
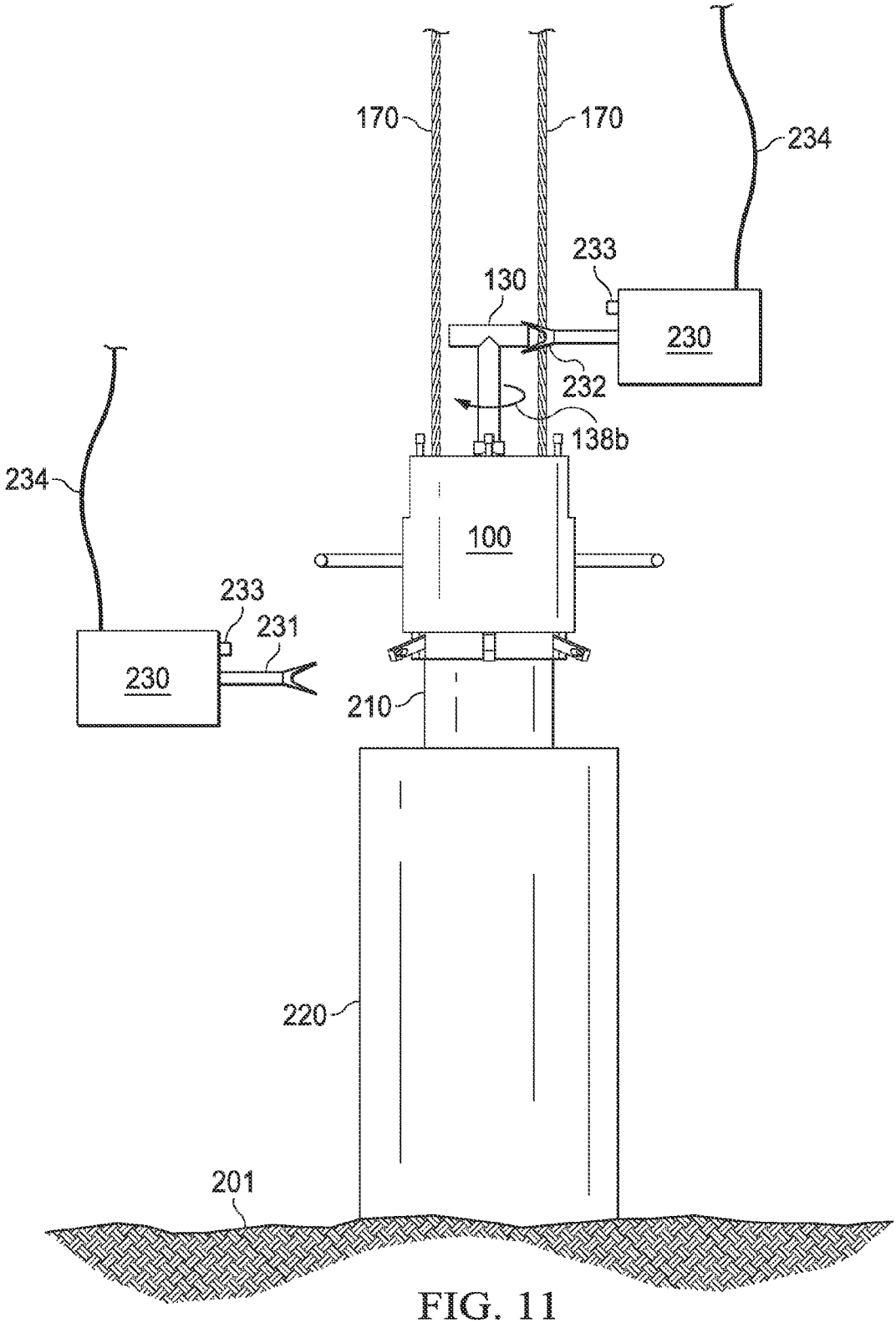
FIGS. 11 and 12 schematically illustrate the tool of FIG. 1 being actuated subsea to positively engage the lodged pipe stub of FIGS. 7-10.
Figure 12:
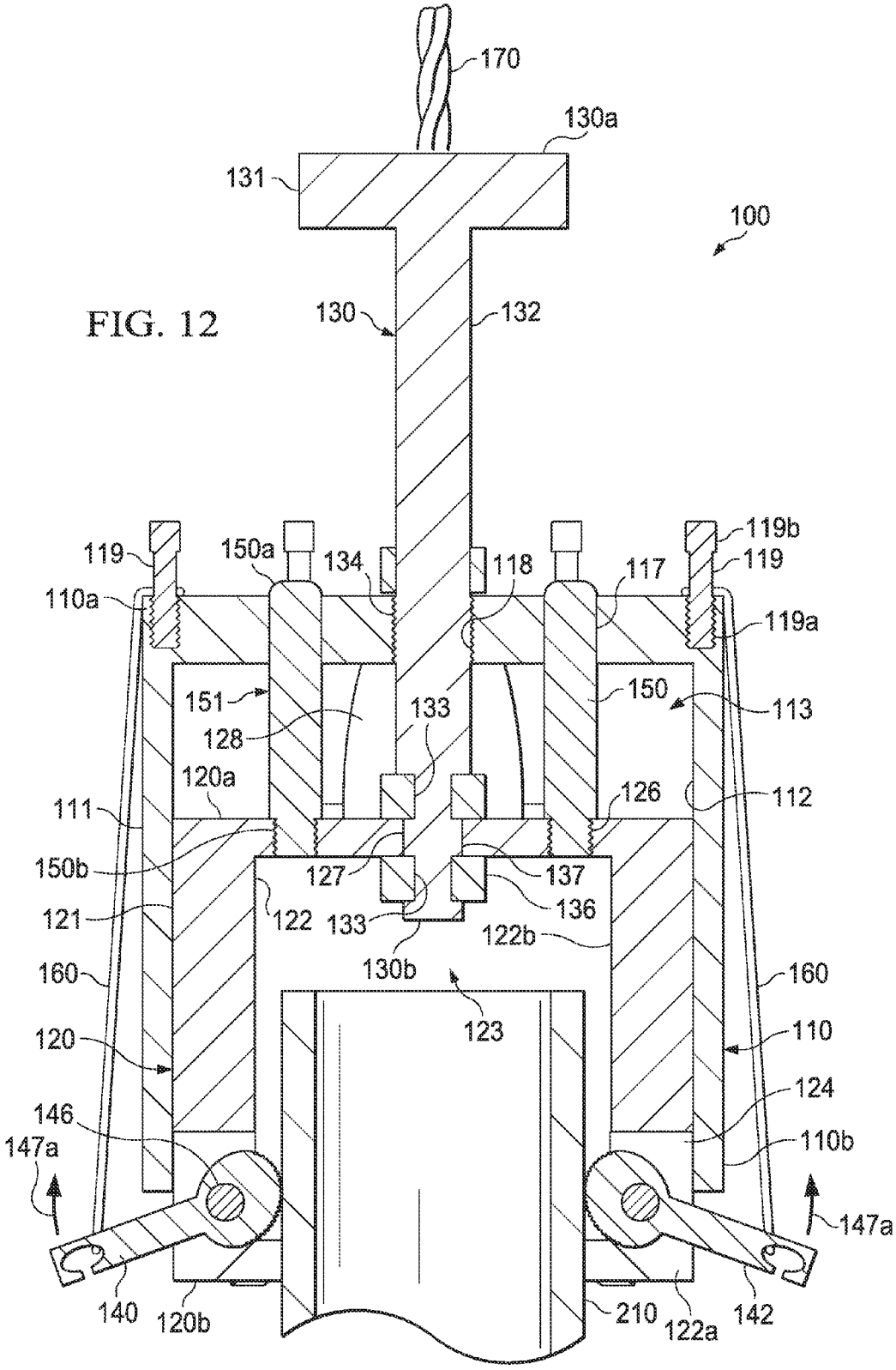
Figure 13:
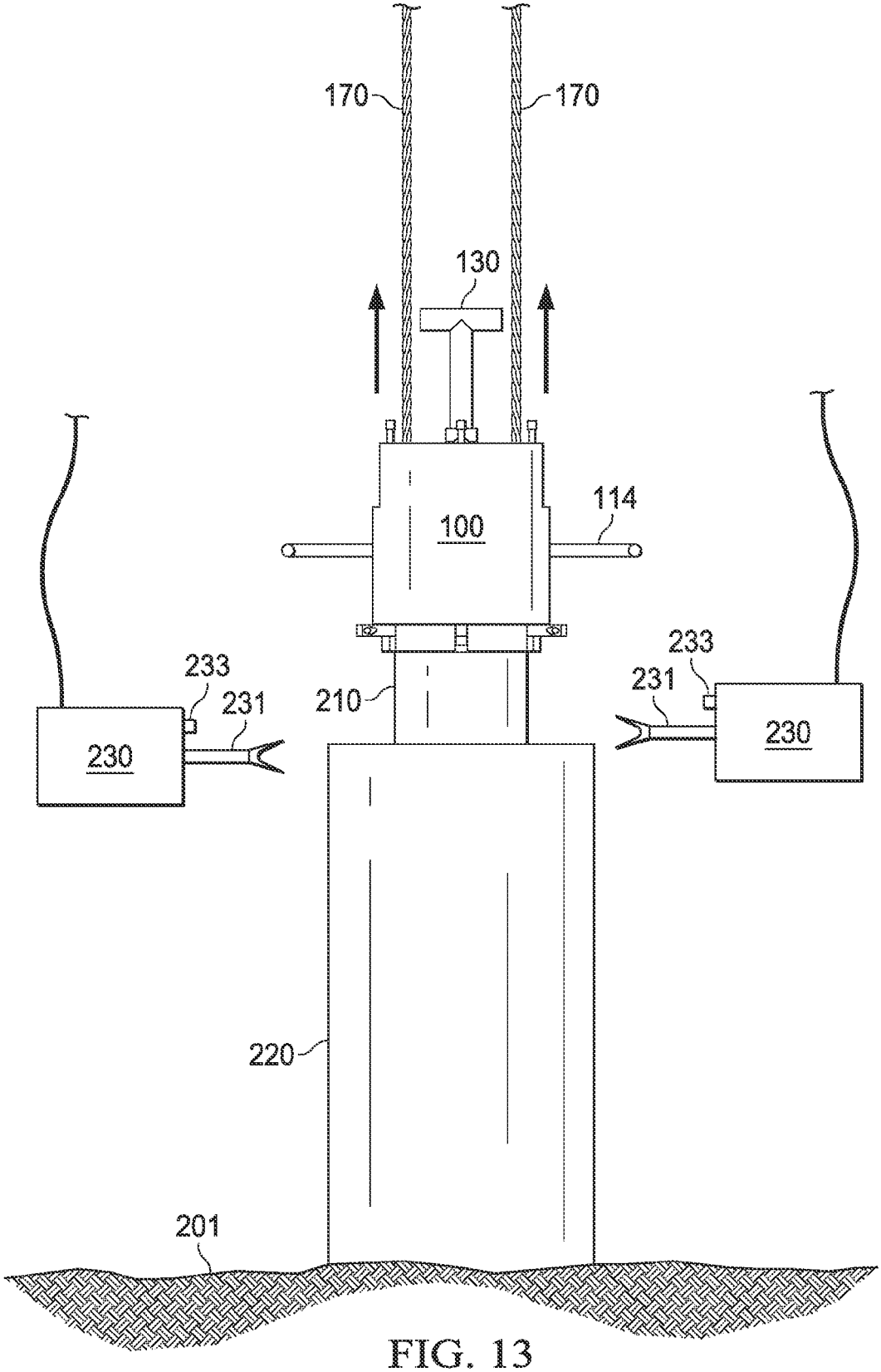
FIGS. 13 and 14 schematically illustrate the tool of FIG. 1 being employed to pull and retrieve the lodged pipe stub of FIGS. 7-10.
Figure 14:
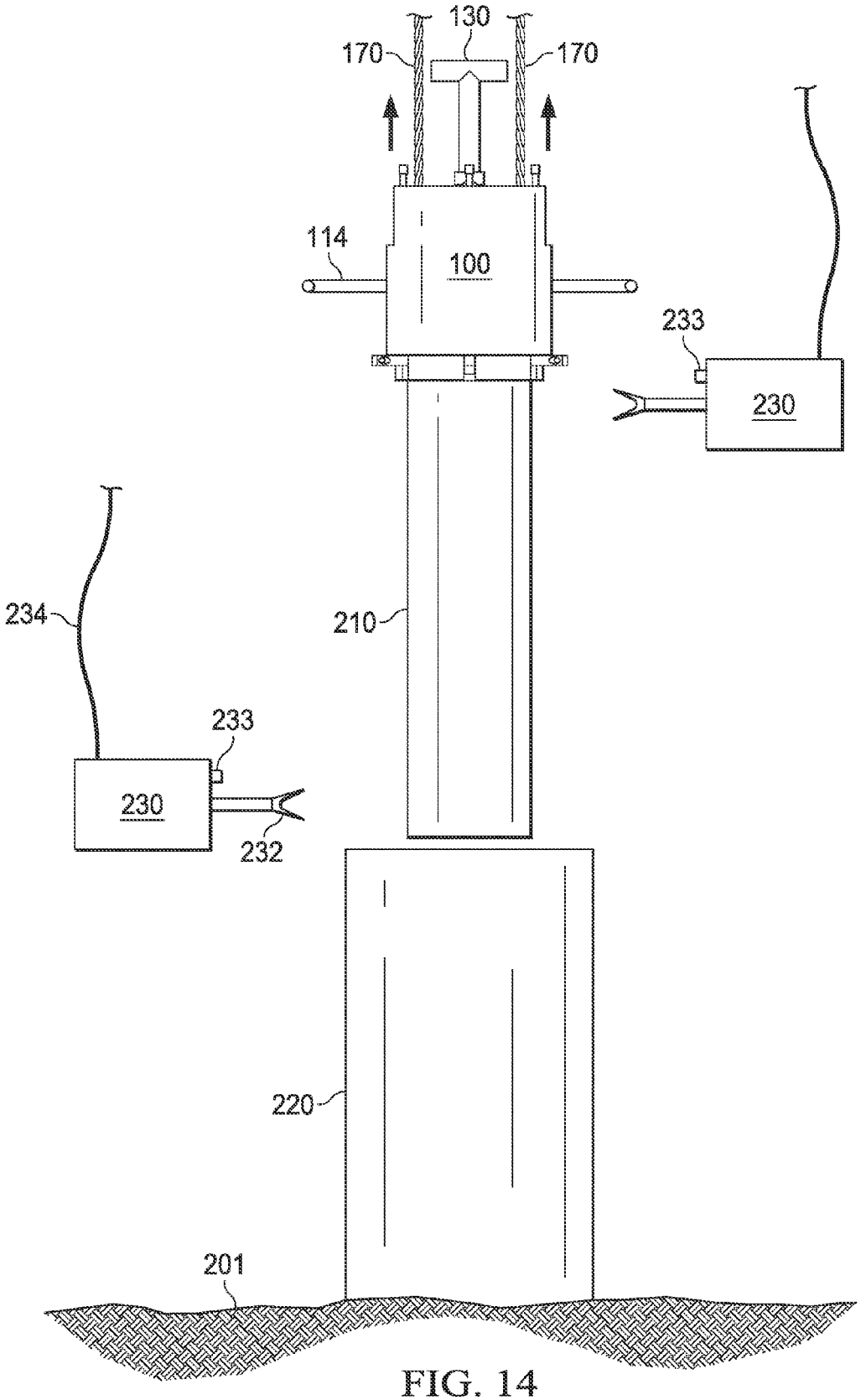

Moving now to FIGS. 11-14, with stub 210 sufficiently received by tool 100, tool 100 is actuated to move gripping surfaces 143 radially inward and into engagement with the outer surface of stub 210. In particular, one or more ROVs 230 may be used to rotate actuation member 130 in second direction 138*b* to move housing 110 axially upward relative to body 220 as shown in FIG. 11. Moving now to FIG. 12, as a result, lower end 110*b* of housing 110 moves axially upward relative to cam members 140, thereby allowing biasing members 160 to pull lever arms 142 upward in first direction 147*a*, decreasing angle β of each cam member 140, and allowing gripping surfaces 143 to pivot radially inward into engagement with stub 210 (i.e., radius $R_{143}$ to each gripping surface 143 decreases). With gripping surfaces 143 engaging the outer surface of stub 210, an upward lifting or over pull force is applied to cables 170 from the surface vessel (e.g., via winch or crane) as shown in FIG. 13 to energize cam heads 141. In particular, as cables 170 pull tool 100 upward, frictional engagement of gripping surfaces 143 and stub 210 urges a further decrease in angle β of each cam member 140 and associated decrease in radius $R_{143}$ of each gripping surfaces 143, thereby enhancing the positive engagement of cam heads 141 and stub 210. Thus, the tension applied to cables 170 is transferred to stub 210 via cam members 140. The tension may be increased, as tool 100 and stub 210 are monitored by ROVs 230, until stub 210 is dislodged and pulled from component 220 as shown in FIG. 14. Without being limited by this or any particular theory, the increase in the gripping force between cam heads 141 and stub 210 is proportional to the increase in the over pull force. The dislodged stub 210 may then be lifted to the surface and released from tool 100, or released from tool 100 subsea. To release stub 210, actuation member 130 is rotated in first direction to move housing 110 axially downward relative to body 120, thereby pushing lever arms 142 downward in a second direction 147*b*, increasing angle β, and radius $R_{143}$ to each gripping surface 143 increases. When radii $R_{143}$ are sufficiently large (e.g., greater than the outer radius of stub 210), stub 210 will be released from tool 100.

Figure 15:
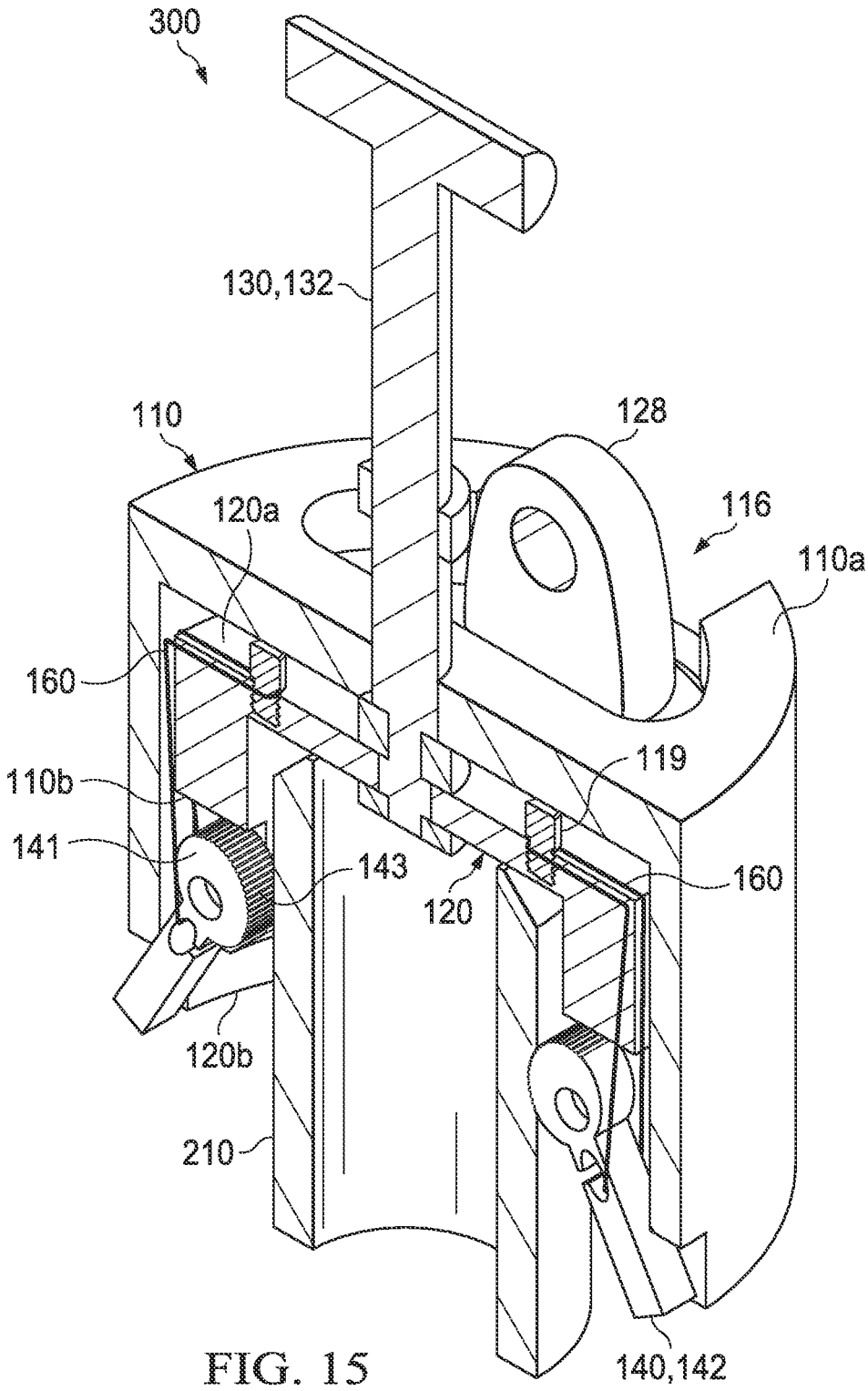
FIGS. 15 and 16 are cross-sectional views of an embodiment of a pipe stub pulling tool in accordance with the principles described herein.
Figure 16:
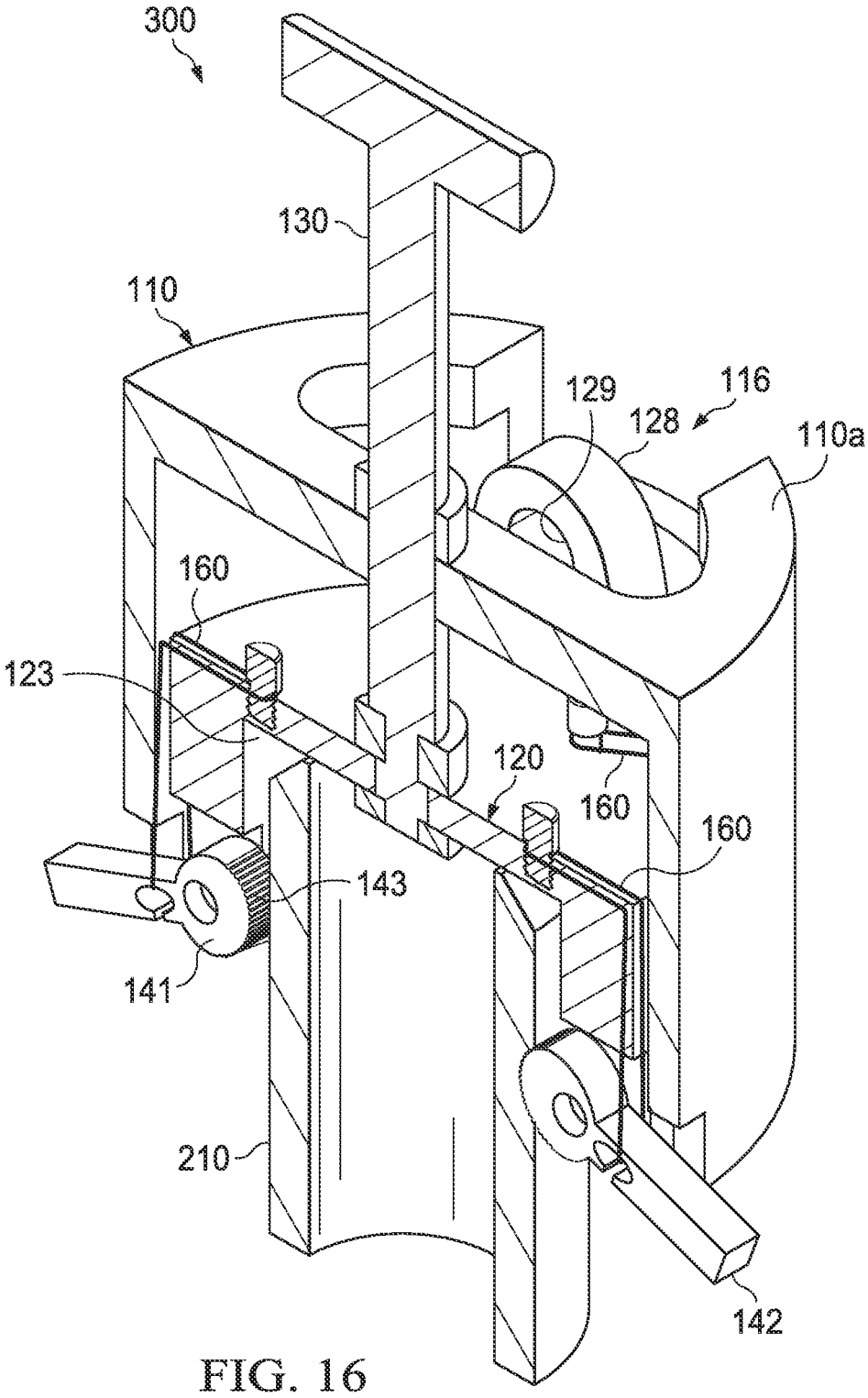

Referring now to FIGS. 15 and 16, another embodiment of a pipe stub pulling tool 300 is shown. Tool 300 is substantially the same as tool 100 previously described. Namely, tool 300 includes a radially outer release body or housing 110, a stub receiving body 120 coaxially disposed within housing 110, an actuation member 130 extending between housing 110 and body 120, and a plurality of cam members 140 rotatably coupled to body 120, each as previously described. However, in this embodiment, circumferentially spaced coupling members 119 are threaded into mating receptacles in upper end 120*a* of body 120, and biasing members 160 extend from members 119 to lever arms 142 between housing 110 and body 120. Otherwise, tool 300 functions in the same manner as tool 100 previously described. In FIG. 15, gripping surfaces 143 and cam heads 141 are shown in a radially retracted position relative to pipe stub 210 and axes 115, 125, thereby resulting in a radial clearance or gap between each gripping surface 143 and pipe stub 210; and in FIG. 16, gripping surfaces 143 and cam heads 141 have been radially advanced relative to axes 115, 125 and into positive engagement with pipe stub 210.

The embodiment of tool 300 shown in FIGS. 15 and 16 provides some added protection to biasing members 160 as compared to tool 100 previously described. Namely, in tool 300, biasing members 160 are disposed within housing 110, and thus, are shielded from the outside environment by housing 110. Whereas, in tool 100, biasing members 160 are disposed outside housing 110 and are exposed to the outside environment. However, replacing, servicing, and maintaining biasing members 160 is generally simpler and easier in tool 100 since biasing members 160 can be easily accessed without breaking down tool 100.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A device for retrieving a subsea tubular, comprising:

a housing having a housing first end and an opened end opposite the housing first end;

a receiving body slidingly disposed within the housing, wherein the body has a central axis, a body first end proximal the housing first end, a body second end proximal the opened end of the housing, and a receptacle extending axially from the body second end;

an actuation member coupled to the housing and the body, wherein the actuation member is configured to move the housing axially relative to the body;

a plurality of cam members, wherein each cam member is rotatably coupled to the body second end and has a longitudinal axis, a cam head at a first end of the cam member and extending radially into the receptacle, and a lever arm extending from the cam head to a second end of the cam member opposite the first end of the cam member;

wherein each cam member is configured to rotate in a first direction to move the cam head radially inward relative to the central axis and rotate in a second direction opposite the first direction to move the cam head radially outward relative to the central axis;

wherein the opened end of the housing axially abuts the lever arm of each cam member; and a plurality of biasing members, each biasing member being coupled to the lever arm of one cam member and configured to bias the cam member in the first direction.

2. The device of claim 1, wherein each biasing member has a first end connected to the housing first end and a second end connected to the lever arm of one cam member; and wherein each biasing member is radially positioned outside the housing.

3. The device of claim 1, wherein each biasing member has a first end connected to the body first end and a second end connected to the lever arm of the one cam member; and wherein each biasing member is radially positioned between the housing and the body.

4. The device of claim 1, wherein the housing first end includes a throughbore and the body first end includes a throughbore radially aligned with the throughbore in the housing; and wherein the actuation member comprises a shaft extending through the throughbore in the housing and the throughbore in the body;

wherein the shaft threadably engages the throughbore in the housing and rotatably engages the throughbore in the body;

wherein the shaft is configured to be rotated in a first direction to move the housing axially upward relative to the body and rotated in a second direction opposite the first direction to move the housing axially downward relative to the body.

5. The device of claim 4, wherein the shaft is axially fixed to the body and is configured to rotate relative to the body.

6. The device of claim 1, further comprising a plurality of guide members extending from the body first end to the housing first end, wherein each guide member is secured to the housing first end and slidingly engages a bore in the housing first end.

7. The device of claim 1, wherein the body first end includes a plurality of connection members configured to connect cables to the body.

8. A method for retrieving a tubular lodged in a subsea component, the method comprising:

(a) positioning a retrieval tool subsea to the tubular, wherein the tool comprises:

an outer housing;

a tubular receiving body disposed within the housing, the body having a central axis, a first end, a second end opposite the first end, and a receptacle extending axially from the second end;

a plurality of circumferentially spaced cam members rotatably coupled to the second end of the body, wherein each cam member has a cam head extending radially into the receptacle and a lever arm extending from the cam head;

(b) receiving an end of the tubular into the receptacle;

(c) moving the housing axially upward relative to the body; and (d) pivoting each cam member in a first direction relative to the body during (c) to engage the tubular with a gripping surface of each cam head.

9. The method of claim 8, further comprising:

pivoting each cam member in a second direction opposite the first direction to radially retract each cam head before (b).

10. The method of claim 9, wherein the gripping surface of each cam head is disposed at a radius $R_1$ that is greater than an outer radius of the tubular after radially retracting each cam head.

11. The method of claim 8, wherein (d) comprises moving each gripping surface radially inward to engage the tubular.

12. The method of claim 8, further comprising:

biasing each cam member in the first direction.

13. The method of claim 12, further comprising: limiting the pivoting of each cam member in the first direction with a lower end of the housing.

14. The method of claim 8, further comprising:

(e) applying an axial force to the body after (d);

(f) applying the axial force to the tubular with the cam members during (e); and (g) lifting the tubular from the component during (f).

15. The method of claim 8, further comprising:

coupling cables to the body;

wherein (a) comprises lowering the tool subsea with the cables.

16. The method of claim 8, further comprising:

utilizing one or more ROVs to coaxially align the body with the tubular before (b).

17. The method of claim 8, wherein (c) comprises:

rotating an actuation member in a first direction to move the housing axially upward relative to the body.

18. The method of claim 17, wherein the actuation member comprises a shaft extending through a throughbore in the housing and a throughbore in the body; and wherein the shaft threadably engages the throughbore in the housing and rotatably engages the throughbore in the body.

19. The method of claim 18, wherein the shaft is rotated in the first direction with at least one ROV.

20. A method for retrieving a subsea tubular, comprising:

(a) positioning a retrieval device subsea, wherein the device comprises:

a housing;

a body moveably disposed within the housing, the body having a central axis and a receptacle for receiving an end of the tubular;

a plurality of circumferentially spaced cam members rotatably coupled to the body, wherein each cam member has a cam head extending radially into the receptacle;

(b) positioning the end of the tubular in the receptacle with one or more subsea ROVs;

(c) moving the housing axially upward relative to the body with the one or more subsea ROVs; and (d) moving each cam head into engagement with the tubular during (c).

21. The method of claim 20, further comprising:

moving the housing axially downward relative to the body before (b); and moving each cam member radially outward simultaneous with moving the housing axially downward relative to the body.

22. The method of claim 20, further comprising:

(e) applying a pulling force to the body after (d); and (f) increasing the engagement of each cam head with the tubular during (e).

23. The method of claim 22, further comprising:

biasing the cam heads radially inward during (a) to (f).

* * * * *